US006997361B2

(12) United States Patent
Zacharias et al.

(10) Patent No.: US 6,997,361 B2
(45) Date of Patent: Feb. 14, 2006

(54) METALLURGICAL IMPACT PAD

(75) Inventors: Donald Richard Zacharias, Parma, OH (US); John Morris, Berea, OH (US); Eric Wotsch, Lakewood, OH (US)

(73) Assignee: Foseco International Limited, Tamworth (GB)

( * ) Notice: Subject to any disclaimer, the term of this patent is extended or adjusted under 35 U.S.C. 154(b) by 0 days.

(21) Appl. No.: 10/395,150

(22) Filed: Mar. 25, 2003

(65) Prior Publication Data

US 2003/0183362 A1 Oct. 2, 2003

Related U.S. Application Data

(60) Provisional application No. 60/367,743, filed on Mar. 28, 2002.

(51) Int. Cl.
*C22B 41/08* (2006.01)

(52) U.S. Cl. ..... 222/594; 266/275; 266/236
(58) Field of Classification Search ..... 266/275, 266/236; 222/591, 594

See application file for complete search history.

(56) References Cited

U.S. PATENT DOCUMENTS 5,518,153 A * 5/1996 Zacharias et al. ..... 222/594
6,024,260 A * 2/2000 Zacharias et al. ..... 222/594
2002/0033567 A1 * 3/2002 Morales et al. ..... 266/283

FOREIGN PATENT DOCUMENTS

WO WO 00/74879 A1 * 12/2000

* cited by examiner

*Primary Examiner*—Scott Kastler
(74) *Attorney, Agent, or Firm*—Nixon & Vanderhye, PCC.

(57) ABSTRACT

A tundish impact pad formed from refractory material comprising a base having an impact surface which, in use, faces upwardly against a stream of molten metal entering a tundish, a wall extending upwardly from the base around at least a part of the periphery of the impact surface, one or more portions of the upper part of the wall supporting one or more overhangs which project inwardly over the periphery of the base. At least one of said overhangs has at least a part whose under-surface curves or slopes, the curvature or slope lying in a direction along the length of the wall. Preferably the pad has rectangular base and a pair of opposite walls is provided with an overhang that arches upwardly towards the centre of the wall. An overhang on the second pair of walls can be, for example, planar and parallel to the base. The width of the curved or sloping overhangs increases in both directions away from its centre/top.

25 Claims, 12 Drawing Sheets

FIG 9
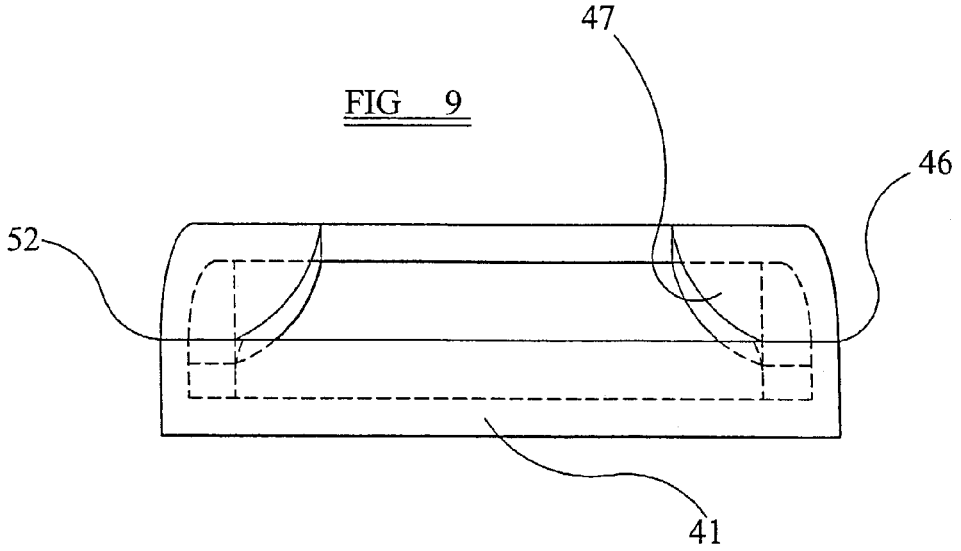
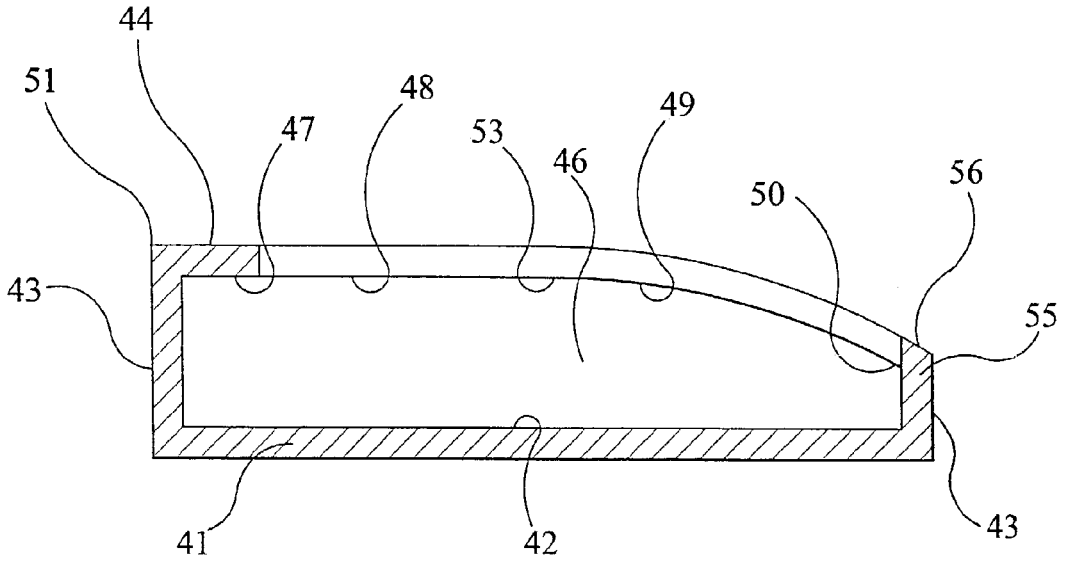
FIG 10

METALLURGICAL IMPACT PAD

This application claims the benefit of Provisional Application No. 60/367,743, filed Mar. 28, 2002, the entire content of which is hereby incorporated by reference in this application.

The present invention relates to a refractory article known in the art as an "impact pad" for use in handling molten metals, especially steel. The invention particularly relates to an impact pad for placement in a tundish for reducing turbulence in a flow of molten steel entering the tundish. The present invention finds particular utility in the continuous casting of steel.

Tundishes act as holding tanks for said molten metal, and especially for molten steel in commercial processes for the continuous casting of steel. In the continuous casting of steel, the molten steel fed to the tundish is generally high-grade steel that has been subjected to various steps for rendering it suitable for the particular casting application. Such steps normally involve, for example, one or more steps to control the levels of the various elements present in the steel, for example the level of carbon or other alloying ingredients, and the level of contaminants such as slag. The residence of the steel in the tundish provides a further opportunity for any entrained slag and other impurities to segregate and float to the surface where they can be, for example, absorbed into a special protective layer provided on the surface of the molten steel. Thus the tundish can be used to further "clean" the steel before it is fed to the mould for casting.

To optimise the ability of the tundish to continuously furnish a supply of clean steel to the mould, it is highly desirable to control and streamline the flow of steel through the tundish. Molten steel is normally fed to the tundish from a ladle via a shroud which latter protects the stream of steel from the surrounding atmosphere. The stream of molten steel from the ladle generally enters the tundish with considerable force, and this can generate considerable turbulence within the tundish itself. Any undue turbulence in the flow of molten steel through the tundish has a number of undesirable effects including, for example; preventing slag and other undesirable inclusions in the steel from agglomerating and floating to the surface; entraining into the molten steel a part of the protective crust that forms, or is specifically provided, on the surface of thereof; entraining gas into the molten steel; causing undue erosion of the refractory lining within the tundish; and generating an uneven flow of the molten steel to the casting mould.

In an effort to overcome these problems the industry has undertaken extensive research into various designs of impact pads for reducing turbulence in the tundish arising from the incoming stream of molten steel, and for optimising the flow within the tundish to approximate ideal "plug flow" characteristics as nearly as possible of the molten steel as it traverses the tundish. Generally speaking it has been found that the flow of molten steel through the tundish can often be improved using impact pads that have specially designed surfaces capable of redirecting and streamlining the flow of molten steel.

Impact pads disclosed in the prior art generally comprise a base against which a downwardly directed stream of molten steel impinges, and a vertical sidewall or sidewall elements that redirect the stream. They are fabricated from refractory materials capable of withstanding the corrosive and erosive effects of a stream of molten steel for their working lives. They are frequently shaped in the form of shallow boxes having, for example, square, rectangular, trapezoidal or circular bases.

WO 96/14951 (Foseco) discloses a tundish impact pad comprising a body of refractory material capable of withstanding contact with molten steel in a tundish. The impact pad body comprises a base having an impact surface, an outer sidewall extending upwardly from the impact surface, and a top surface connected to the sidewall and defining an opening therein. The top surface has an inner annular portion substantially parallel to the impact surface, and there is a substantially right-angled corner between the sidewall and the impact surface, and also between the sidewall and the inner annular portion of the top surface. The impact pad provides increased residence time of the molten steel in the tundish, which is important to ensure that unwanted inclusions have sufficient time to float to the surface of the steel and to be removed.

WO 97/37799 (Foseco) discloses a tundish impact pad comprising a body of refractory material capable of withstanding contact with molten steel in a tundish. The impact pad body comprises a base having an impact surface for molten steel, an outer sidewall extending upwardly from the impact surface and extending around the base to completely enclose it. An annular body portion connected to the sidewall provides a top surface substantially parallel to the impact surface and defines an opening into which molten steel can be poured, the lower surface of the annular body portion and the inner face of the sidewall defining a recess having an undercut portion extending continuously around and above the impact surface. A portion of the top surface is at a lower level than the remainder of the top surface and the recess beneath the portion of the top surface is of smaller cross-section than the remainder of the recess. This impact pad is particularly useful for improving the flow characteristics in elongate tundishes in which the molten steel is poured into the tundish at an end of the tundish and the, or each outlet for the steel is at the opposite end of the tundish. The impact pad is oriented such that the lower level portion of the end wall is adjacent to the end wall next to the incoming stream of molten steel, so that the steel rebounding from the pad preferentially flows towards this end wall. This has the effect of markedly reducing the surface turbulence created in the tundish and generally improving the flow paths, resulting in the production of cleaner steel.

WO 00/74879 (Foseco) discloses a tundish impact pad formed from refractory material, the impact pad comprising a base having an impact surface which in use faces upwardly to receive molten metal poured onto the impact pad, and a wall extending upwardly from the base around at least part of the periphery of the impact surface, the wall including an overhang projecting over a peripheral region of the impact surface, the overhang including a plurality of protrusions which project further over the impact surface than the remainder of the overhang.

In prior art impact pads possessing a sidewall with an overhang, ie an inwardly directed peripheral strip, such overhang portions have underside surfaces which lie above, and substantially parallel to the base impact surface of the impact pad.

It will be appreciated that the process of designing a new tundish impact pad which meets particular pre-determined criteria is extremely complex, since changing one aspect of the design of an impact pad generally has unforeseen ramifications on the flow dynamics of the entire tundish system.

It is an object of the present invention to provide an improved impact pad suitable for placement in a tundish for reducing turbulent flow of molten metal introduced therein.

The present invention provides a tundish impact pad formed from refractory material comprising a base having an impact surface which, in use, faces upwardly against a stream of molten metal entering a tundish, a wall extending upwardly from the base around at least a part of the periphery of the impact surface, one or more portions of the upper part of the wall supporting one or more overhangs which project inwardly over the periphery of the base, characterised in that the overhang or at least one of said overhangs has at least a part whose under-surface curves or slopes, the curvature or slope lying in a direction along the length of the wall.

The slope or curvature lies in a direction along the length of the wall. This means that in vertical cross-sections taken through the overhang in planes parallel to the plane of the adjacent wall, the line delineating the undersurface of the overhang will (1) be curved and/or (2) will be a straight line (or lines) sloping at an angle to the horizontal.

In the case that the said vertical cross-section of the overhang is curved, the angles made between tangents to the curve and the horizontal preferably lie in the range of 0° to 45°. In the case that the said vertical cross-section of the overhang is a sloping straight line, the angle of the slope to the horizontal preferably lies in the range 2° to 45°, for example 5° to 30°.

The presence of said slope or curvature can also be verified, for example, by taking measurements of the height of the overhang at a plurality of equally spaced intervals along a horizontal line on, or parallel to, the inner perimeter of the wall. Such measurements will vary in relation to the contours of the curve or slope.

In the case of a non-planar wall, or an inwardly or outwardly leaning wall, the term "the plane of the wall" is to be understood as a reference pane which is a vertical plane tangential to the perimeter of the base below the point where the presence of said slope or curvature is to be determined.

The under-surface of the overhang can, for example, curve upwardly and/or downwardly in a direction along the inner perimeter of the wall thereby forming arched or partially arched roof portions and/or can comprise one or more linearly sloping roof portions. The under-surface of the overhang can also contain, in addition to the defined sloping or curved portion(s), one or more horizontal portions.

The average gradient of a sloping or curving surface can be defined in terms of the angle formed between the horizontal, and a straight line joining the lowest and highest points of the said surface. In the present invention the said average gradient preferably lies in the range 2° to 45°, most preferably 5° to 20° to the horizontal.

The base of the impact pad can be of any suitable shape, for example, polyhedral shapes such as, for example, square, rectangular, trapezoidal, rhomboidal, hexagonal, octagonal, circular or elliptical. Preferred shapes are square, rectangular and trapezoidal.

The impact surface of the base is adapted to receive the main force of the flow of metal entering the tundish. It can be, for example, planar, concave or convex. The base itself can, if desired, be affixed to the base of a tundish using any suitable means, for example, using refractory cement, or by locating the base by means of corresponding elements formed in the surface of the refractory lining of the tundish and the underside of the impact pad. Preferably the impact pad is embedded into the refractory base of the tundish. This can be achieved, for example, by placing the impact pad on the monolithic refractory lining of a tundish, placing a layer of cold cure or hot cure refractory power composition to surround the base and optionally part of the outer wall of the impact pad, and then curing the refractories to bind the impact pad in position in the tundish.

The wall extending upwardly from the base around at least a part of the periphery of the impact surface is preferably made from the same material as the base and is preferably integral therewith. Preferably at least one wall extending upwardly from the base around at least a part of the periphery of the impact surface has a mirror image counterpart wall extending upwardly from the opposite peripheral part of the base.

In the case that the impact pad is intended for so-called "two strand" operation, it is preferred that the wall extends around the entire periphery of the base. The wall preferably extends substantially perpendicular in relation to the base. Thus, a linear peripheral portion of the base preferably supports a vertical planar wall portion, whereas a curved portion of the base preferably supports a vertical wall having correspondingly curved horizontal cross section.

In the case that the impact pad has a rectangular or trapezoidal-shaped base and is intended for so called "single strand" operation, the wall preferably extends around three sides of the base, with the fourth side having either no wall, or a relatively low wall.

At least one or more portions of the upper part of the wall support one or more overhangs which project inwardly over the periphery of the base. Preferably the overhang is in the form of an inner peripheral strip projecting inwardly from the wall. Preferably the peripheral strip projects from the top of the wall.

In the case that the impact pad is designed primarily for double strand operation, the overhang, eg a peripheral strip, suitably runs along at least 50%, preferably at least 75% and most preferably 100% of the length of the wall. In the case that the impact pad is designed primarily for single strand operation, the overhang, eg a peripheral strip, preferably runs along 50% to 100%, most preferably 60 to 80% of the length of the wall.

The present invention requires that at least one of said overhangs has at least a part whose under-surface curves or slopes, the curvature or slope lying in a direction along the length of the wall. The overhang having a defined curved and/or sloping under-surface is present over at least 20%, preferably at least 30%, more preferably at least 40% and most preferably at least 50% of the perimeter of the impact pad.

The distance that the overhang extends away from the wall toward the centre of the impact pad is hereinafter referred to as the width of the overhang. This corresponds to the distance, parallel to the base, that it overhangs the base. The distance that the overhang extends along the length of the wall is hereinafter referred to as the length of the overhang.

The width of the overhang is preferably up to 25%, most preferably up to 20%, for example 5 to 15% of the distance across the impact pad from one side to the opposite side. Widths within these percentage ranges preferably allow for sufficient open space for the incoming stream of molten metal to impact on the surface of the base without risk of impinging substantially on the peripheral overhang. The overhang, eg in the form of a peripheral strip, can, if desired, be substantially parallel-sided or can vary in width along its length. For example, the overhang can have the form of a peripheral strip which tapers from zero width at one corner of a square or rectangular impact pad to a width of, for example, 15% of the distance across to the opposite side of the impact pad.

The width of the overhang is preferably such that the opening in the impact pad, ie the area of space enclosed by the inner perimeter of the upper part of the impact pad, lies in the range 2 to 50%, preferably 5 to 25% of the area of the base of the impact pad.

The overhang, eg a peripheral strip, extends inwardly from an upper part of the wall of the impact pad and hence the under surface of the strip lies above a peripheral area of the impact surface. Thus the overhang or peripheral strip effectively forms a partial roof above said impact surface. In accordance with the present invention the underside of the overhang preferably either (1) curves upwardly and/or downwardly thereby forming arched or partially arched roof portions as it traverses along the inner perimeter of the wall and/or (2) comprises one or more linearly sloping roof portions. In the case that the under-surface curves, the primary direction of curvature runs parallel to the adjacent wall and hence the surface curves upwardly and/or downwardly in a direction along the length of the wall. In the case that the under-surface is linear (as opposed to curved) it forms a rising or falling roof portion above the peripheral area of the base. Thus, for example, the under-surface may rise from one corner of a rectangular-based impact pad to the next corner, or, for example, it may rise from one corner to a peak and then down again to the next corner. The changes in height are preferably substantially continuous/smooth, by which is meant that there are preferably few or no abrupt changes in the gradient of the under-surface, eg there are few or no sharp angular portions or steps. If any angular portions or stepped portions are included, they preferably have obtuse angles, most preferably angles in the range 90° to <180°, eg angles in the range 160° to <180°.

In another embodiment in accordance with the present invention, the undersurface can take the form, in cross section, of a polygonal segment to provide an arched roof portion comprising a series of linear sloped surfaces.

In the case that the under-surface curves, the curvature may take the form of an arched portion, for example, an arched portion having smoothly-curved cross-section. The curvature need not necessarily correspond to a well-defined standard mathematical curve. However, such standard curvatures can be employed if desired, eg corresponding to, for example, an arc of a conic section, for example circular, elliptical, parabolic or hyperbolic; or to a catenary or a segment thereof.

In the case that the defined curved or sloping overhang occupies, substantially the full length of one or more walls on a polygonal based impact pad, the or each under-surface can have, for example, a length (L) to height (H) ratio lying in the range 30:1 to 3:1, preferably in the range 15:1 to 5:1 wherein "L" is the horizontal distance measured between the lowest and highest points, and "H" is the vertical distance measured between the highest point to the lowest point of the overhang.

In the case that the impact pad is for double strand use, the base thereof is preferably quadrilateral having an overhang or peripheral strip preferably extending along two opposite walls, most preferably along both pairs of opposite walls of the impact pad. Most preferably such an impact pad is square or rectangular and has a wall and an overhang extending around the entire perimeter of the impact pad. Under the latter circumstances it is preferred that two opposite sides have a curved or angled peripheral strip in accordance with the present invention and that the other two opposite sides preferably have overhangs, eg peripheral strips, which are not curved or angled but lie parallel to the base. Preferably the overhangs or peripheral strips in two opposite sides are mirror images of one another.

Thus a preferred impact pad suitable for two-strand operation in accordance with the present invention has a rectangular base, a vertical peripheral wall surrounding the base, and is provided with one pair of overhangs having curved or sloping under-surfaces on a pair of oppositely disposed walls, and a second pair of overhangs having horizontal planar under-surfaces on the second pair of walls.

A preferred impact pad suitable for single strand operation in accordance with the present invention has a square, rectangular or trapezoidal base, a peripheral wall surrounding three sides of the base, and is provided with one pair of overhangs having curved or sloping under-surfaces on the pair of oppositely disposed walls, the third wall having an overhang having a horizontal planar under-surface.

The upper surfaces of the overhang are preferably smooth surfaces. The upper surface can have a profile matching the profile of the under-surface if desired, eg to provide an overhang having a substantially uniform thickness at least in the portion occupied by the curved or sloping portion.

In the case of a rectangular-based impact pad designed for two-strand operation, two opposite sides thereof preferably have walls supporting overhangs having under-surfaces each forming an arch having its minimum width at the centre (top) of the arched portion, becoming wider in a direction moving away from the centre, until it reaches maximum width at the ends of the arched portion and beyond. For example, the width at the top of the arch is preferably 50 to 80% of the width of the overhang in the regions at the ends of, and in the regions at either side of, the arch. The arch in these cases may be a curved arch having the general form of a horizontally extended inverted "U" or a linear roofed arch having the general form of a horizontally extended inverted "V".

In the direction taken at right angles to the inner surface of the wall, the under-surface of the overhang can extend in a linear or curved manner. In the case that the under-surface forms a curved union with the wall, a vertical cross-section taken at right-angles to the surface of the wall will exhibit the line demarking the under-surface of the overhang as a curve.

Thus, the union of the under-surface of the overhang and the surface of the wall can, if desired, take the form of a sharp angle, eg a right angle, an acute angle or an obtuse angle, or can form a curved profile, eg a coved profile having a part cylindrical or other curved cross section.

The junction between the wall and the impact surface (ie the upper surface of the base) can take the form of a sharp angle, eg a right angle, or an acute angle or an obtuse angle, or can be rounded or curved.

The impact pad according to the present invention can be made using the standard moulding techniques well known in the art for forming refractory shaped articles. The impact pad can, if desired, be fabricated in two or more separate parts which can then be joined together to form the final article, or can be fabricated as a monolithic structure (ie, formed in one piece as a single integral article).

The refractory material from which the impact pad is fabricated can be any suitable refractory material capable of withstanding the erosive and corrosive effects of a stream of molten metal throughout its working life. Examples of suitable materials are refractory concretes, for example concretes based on one or more particulate refractories, and one or more suitable binders. Refractories suitable for the manufacture of impact pads are well known in the art, for example alumina, magnesia and compounds or composites thereof. Similarly suitable binders are well known in the art, for example, high alumina cement.

Impact pads in accordance with the present invention can be made for use with tundishes operating in single strand, two strand or multi strand mode. As is well known in the art, continuous casting steel processes operating in single strand and multi strand (delta tundish) modes generally employ impact pads having square, rectangular or trapezoidal cross section (in the horizontal plane) wherein one pair of opposite sides are provided with walls having equal height, a third side also having a wall, and the fourth side either having a lower wall or no wall. In the double (or sometime quadruple) strand technologies, the impact pads generally have square or rectangular cross section wherein a first pair of opposite sides are provided with walls having equal height, and the second pair of opposite sides are also of equal height (which may be the same as, or different from the height of the first pair). In single strand and multiple strand operation the impact pad is generally positioned near one end of the tundish to one side of the area wherein the outlet(s) for the molten steel are situated, whereas in double strand operation the impact pad is generally positioned in the centre of a rectangular tundish with two outlets situated on opposite sides of the impact pad (or in quadruple strand operation, two pairs of outlets situated on opposite sides).

Impact pads in accordance with the present invention can be used, for example, to provide reduced dead volume and/or improved plug flow and/or reduced turbulence in tundishes for holding molten steel.

The invention will now be described with reference to the accompanying drawings wherein:

FIGS. 1 to 31 and FIG. 2A are all diagrammatic representations of impact pads in accordance with the present invention, FIG. 1 is a perspective view of an impact pad intended for so-called "two strand" operation having a generally rectangular shape in accordance with the present invention wherein the overhang on two opposite sides has a curved under-surface. Part of the corner has been cut away to show the cross-sectional shape of the overhang, base and walls; FIG. 2 is a cross-section through the line A—A in FIG. 1 and FIG. 3 is a plan view of the impact pad shown in FIG. 1. FIG. 2A shows a vertical cross-section of the impact pad taken in a plane parallel on the wall through the line $A^1$—$A^1$ in FIG. 1 and showing the changes in height of the overhang at equal intervals along the wall.

FIG. 4 is a perspective view of an impact pad intended for "two strand" operation somewhat similar to FIG. 1 except that the overhang on two opposite sides has a double-sloping linear under-surface. FIG. 5 shows a vertical cross-section of FIG. 4 through the line B—B and FIG. 6 is a vertical cross-section through the line C—C.

FIG. 7 is a perspective view of an impact pad in accordance with the present invention intended for so-called "single strand operation having a generally trapezoidal base shape and wherein the overhang on two opposite sides has a curved under-surface. FIG. 8 is a plan view and FIG. 9 an elevation of the impact pad of FIG. 7. FIG. 10 represents a vertical cross-section through the impact pad on the line D—D shown in FIG. 8.

FIG. 11 is a perspective view of an impact pad in accordance with the present invention intended for so-called "single strand" operation having a generally trapezoidal base shape and wherein the overhang on two opposite sides has a planar sloping under-surface. FIG. 12 is a vertical cross-section through line E—E in FIG. 13. FIG. 13 is a plan view of the impact pad shown in FIG. 11.

Figure 14:
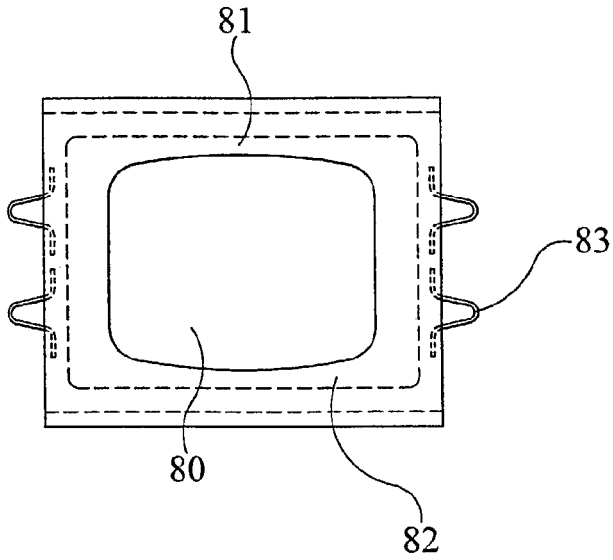
FIG. 14 is a plan view of an impact pad in accordance with the present invention which is of similar form to that shown in FIG. 3 but has the respective overhangs on opposite sides thereof increasing in width from their respective centre portions.
Figure 15:
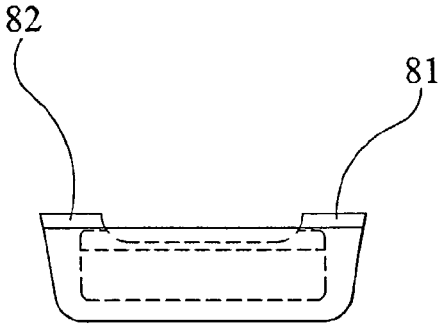
FIG. 15 is an end view of the impact pad shown in FIG. 14, whilst
Figure 16:
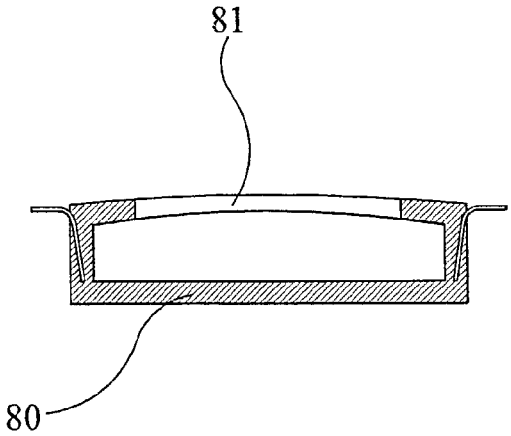
FIG. 16 is a central vertical cross-section through the impact pad.
Figure 20:
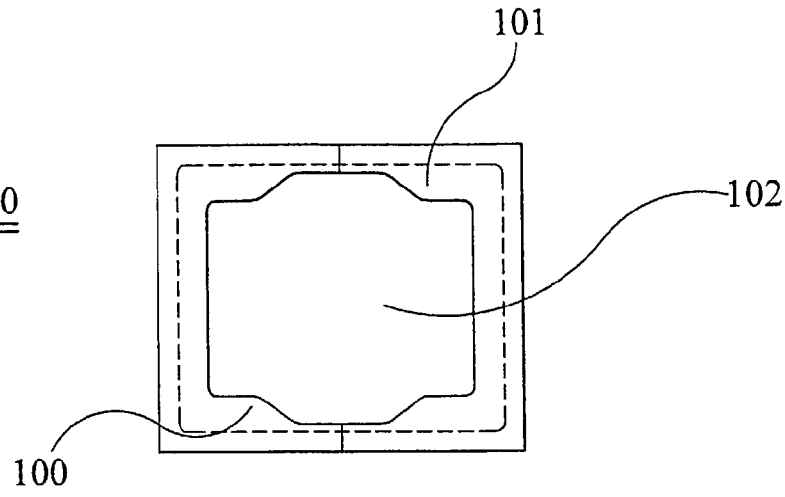
Figure 21:
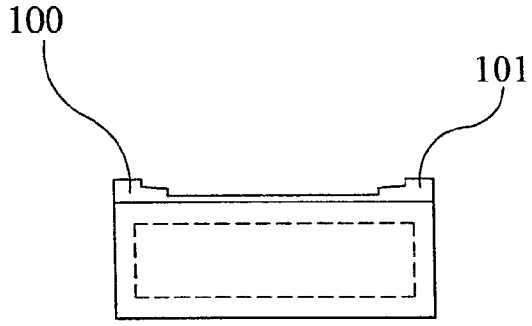
Figure 22:
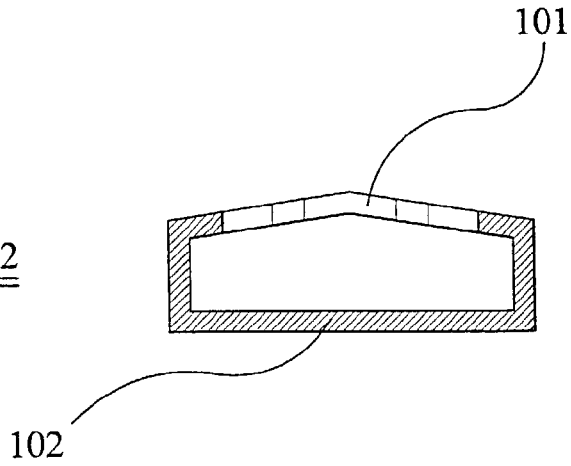

FIGS. 20 to 22 inclusive are similar to FIGS. 14 to 16 respectively, showing the impact pad in accordance with the present invention in plan view, end view and central vertical cross-section respectively, with the width of each overhang on two opposite sides increasing discontinuously from its centre to its respective ends.

Figure 12:
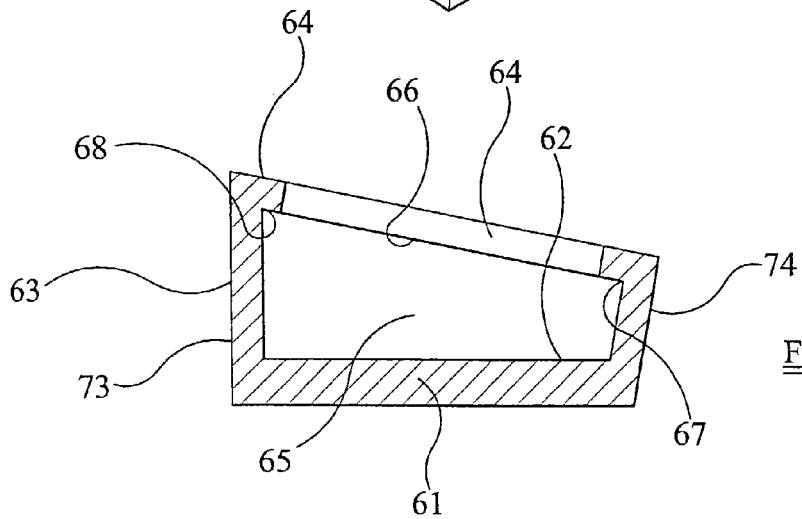
Figure 13:
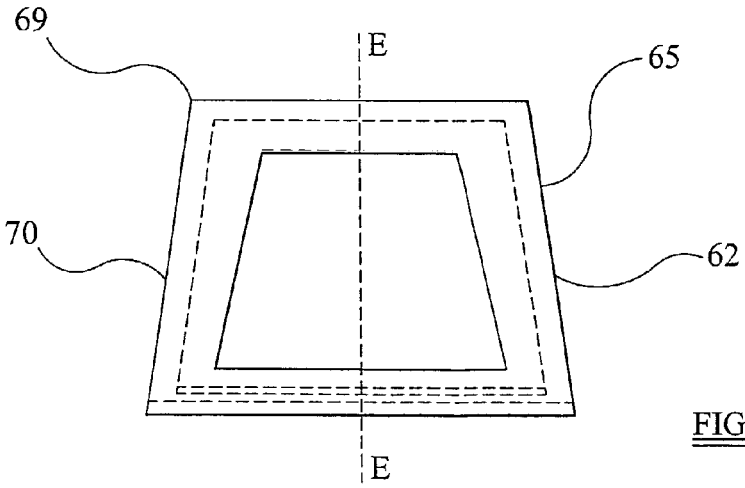
Figure 23:
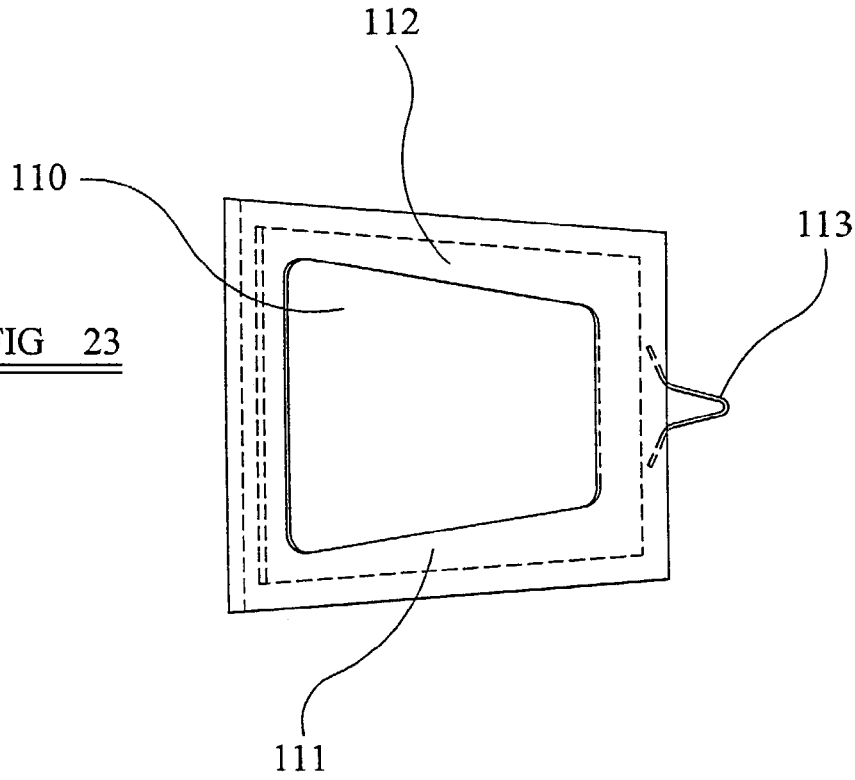
Figure 24:
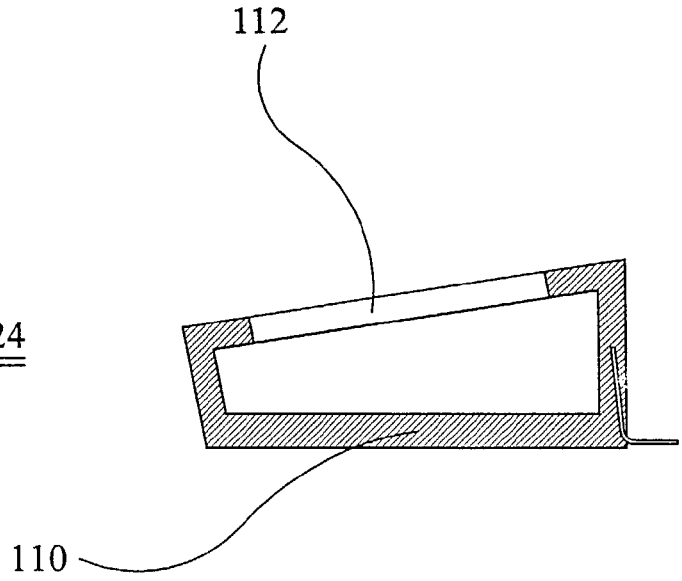

FIG. 23 is a plan view of an impact pad in accordance with the present invention, of similar form to that shown in FIG. 13, whilst FIG. 24 is a central vertical cross-section through the impact of FIG. 23 in a similar manner to that shown in FIG. 12.

Figure 8:
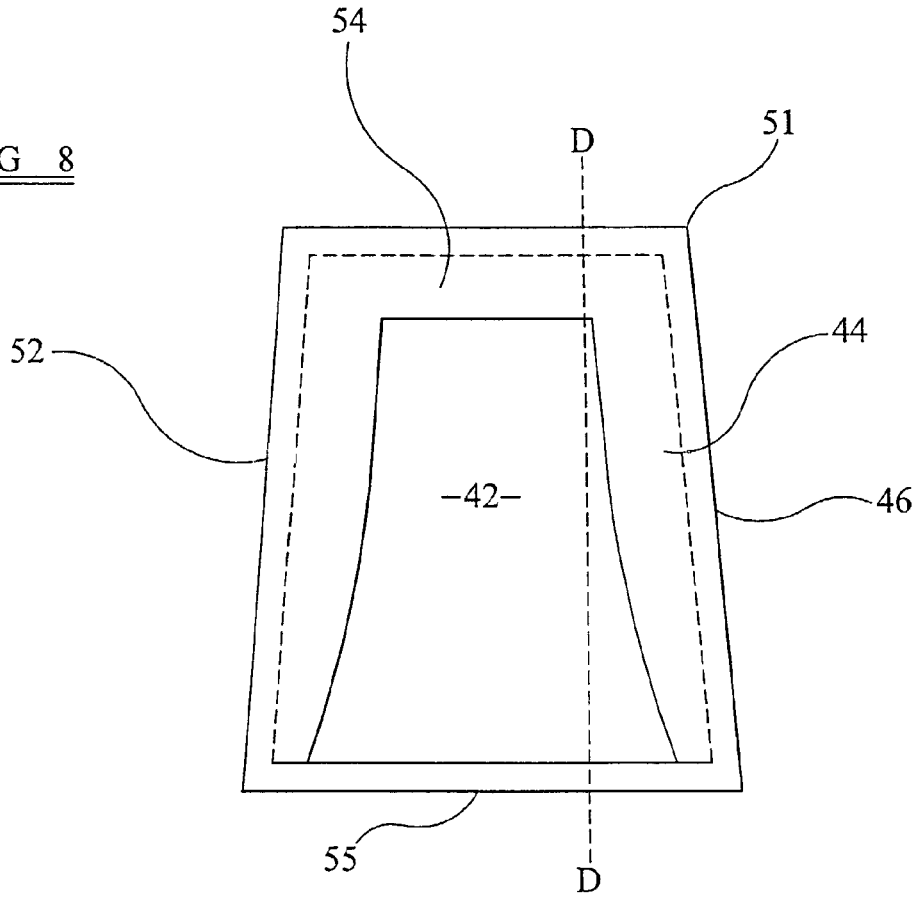
Figure 25:
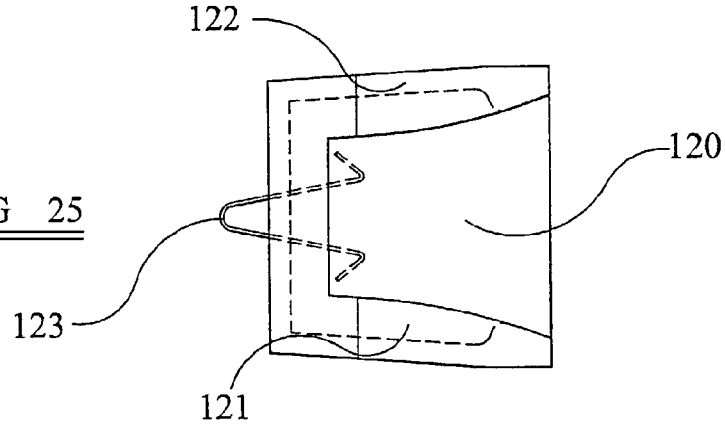
Figure 26:
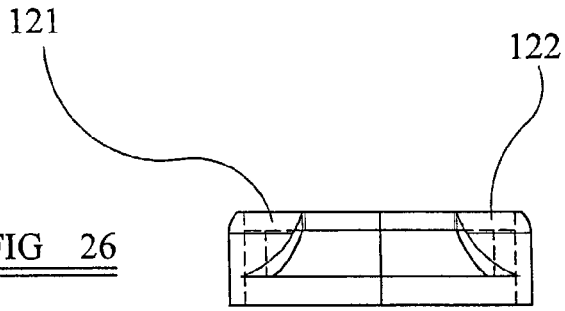
Figure 27:
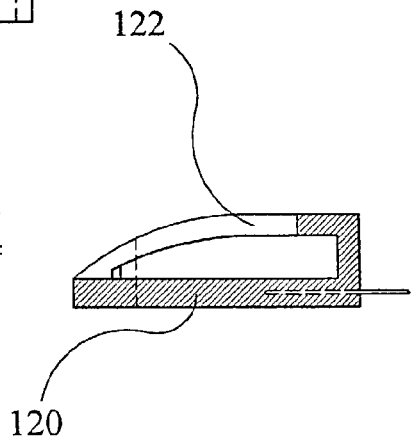
Figure 28:
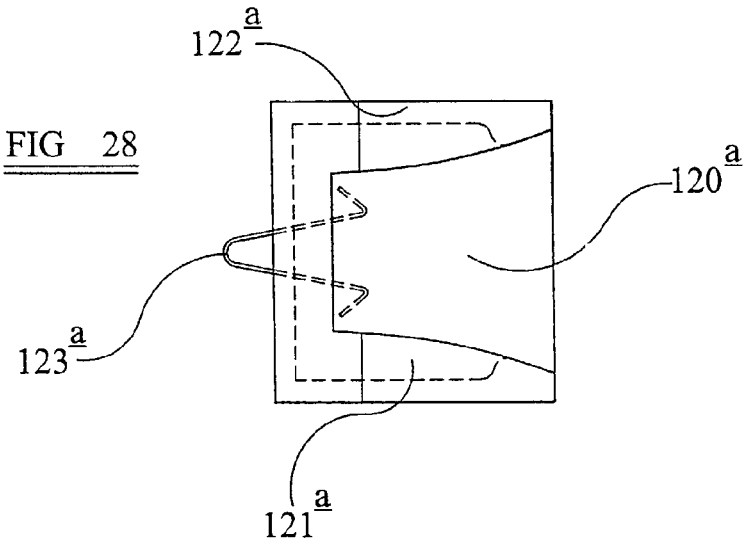
Figure 29:
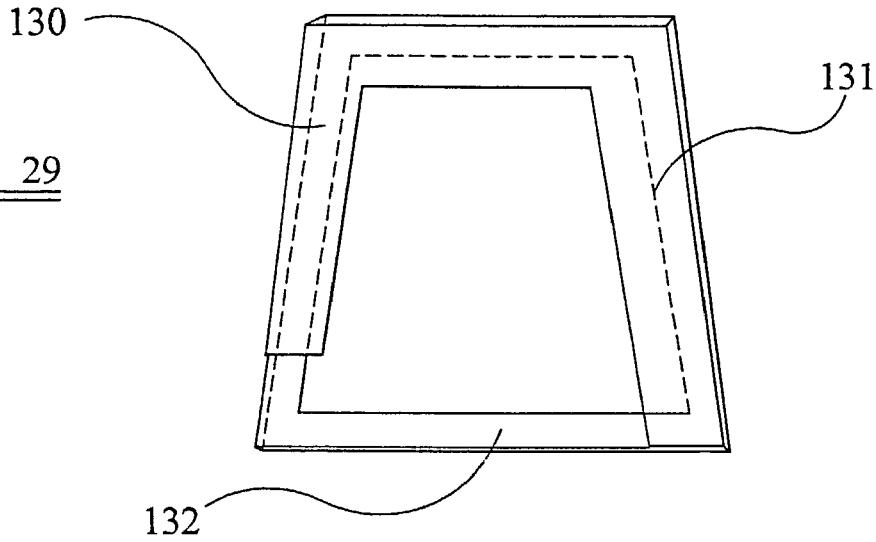
Figure 30:
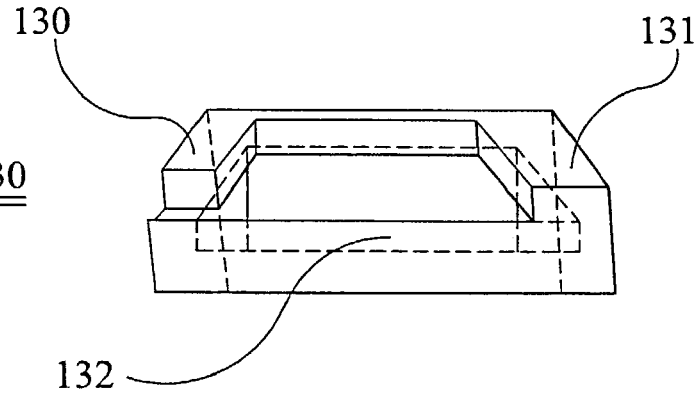
Figure 31:
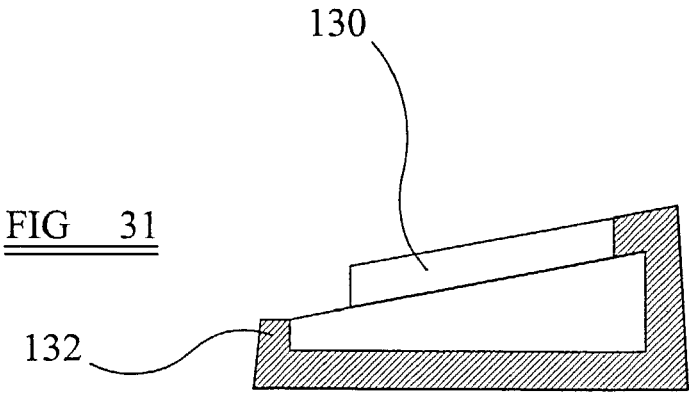

FIGS. 25 to 27 respectively are views similar to those of FIGS. 8 to 10 being a plan view, an end view and a central vertical cross-section respectively of an impact pad in accordance with the present invention for so-called "single strand" operation having a generally trapezoidal base shape, and FIG. 28 is a plan view of an impact pad in accordance with the present invention which is similar to the pad shown in FIG. 25 but is of square base shape, and FIGS. 29 to 31 are views equivalent to FIGS. 25 to 27 respectively, showing an embodiment of an impact pad where one overhang terminates short of the pad wider end wall.

Figure 1:
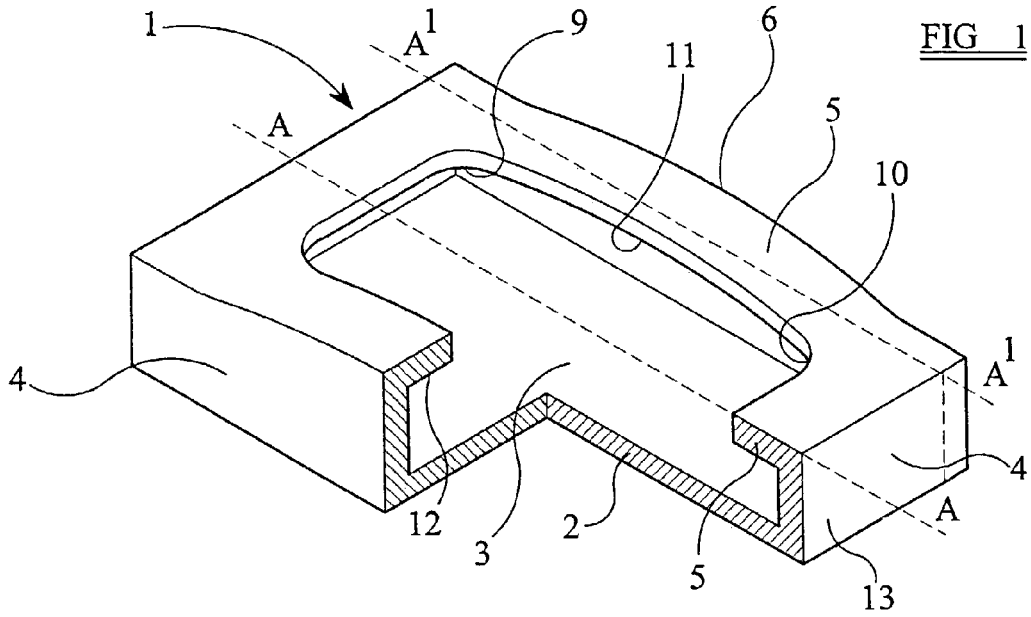
Figure 2:
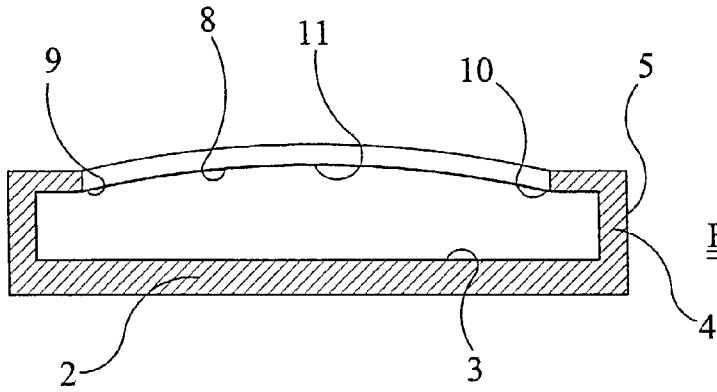
Figure 3:
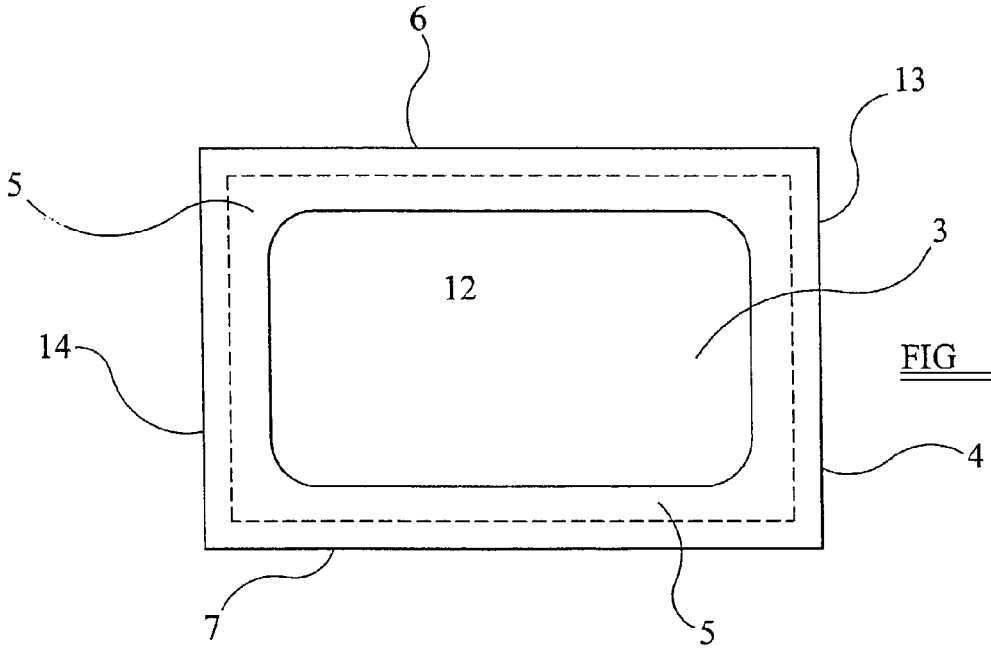
Figure 2A:
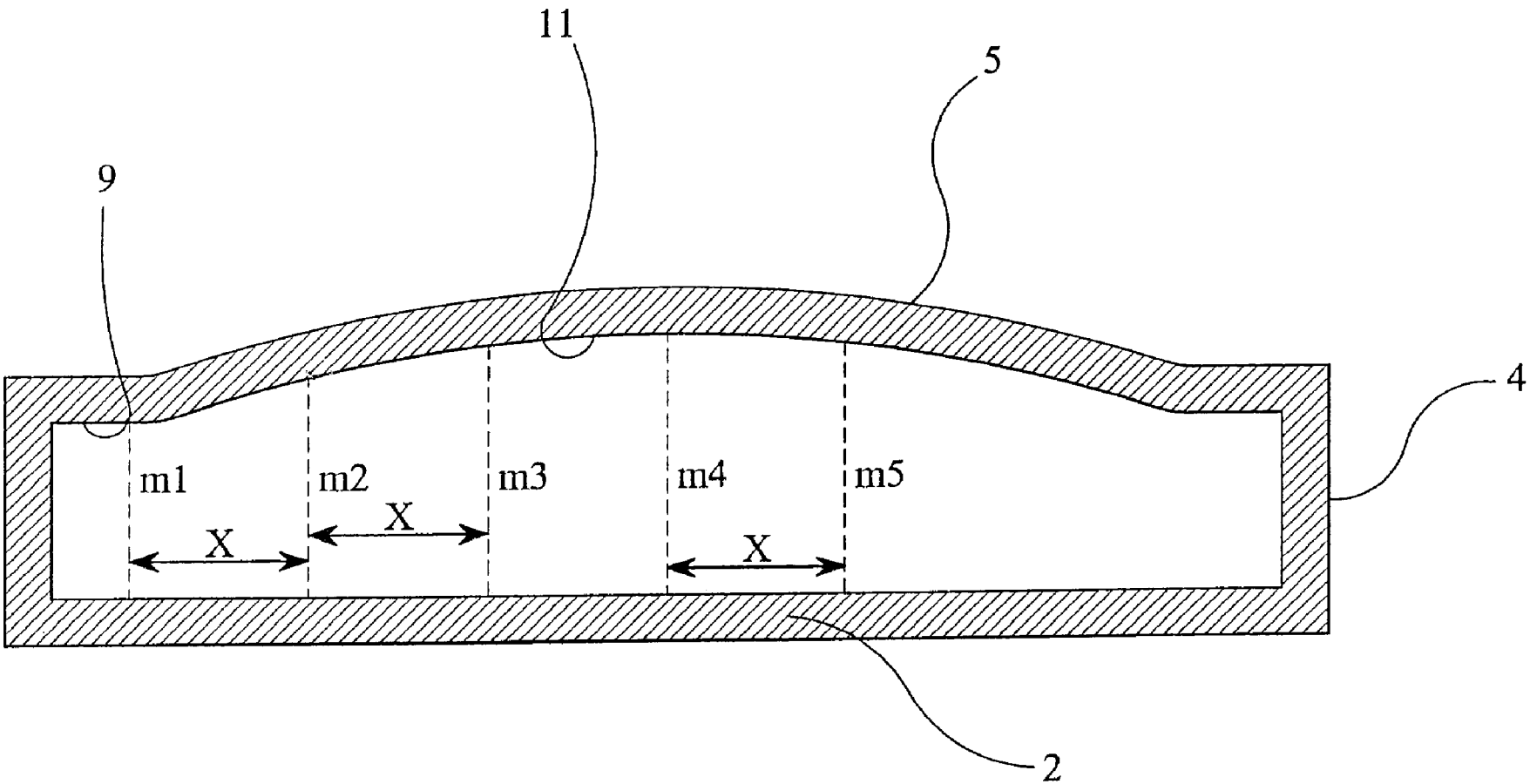

FIGS. 1 to 3 show an impact pad 1 comprising a base 2 having an impact surface 3, a wall 4 extending upwardly from base 2 and an overhang 5 projecting inwardly from wall 4. Along the opposite parallel sides 6 and 7 of the impact pad, the under-surface 8 of the overhang 5 is curved in the form of an arch. Referring to side 6 of the impact pad 1, it can be seen that the vertical height of the overhang above the base increases smoothly, but not linearly, from being a minimum at the end 9 to being a maximum at the central portion 11, and then decreases back to a minimum at 10. Thus the overhang forms an arch-shaped roof over the periphery of the base. Side 7 has a similar arch portion 12, which is a mirror image form of its counterpart on side 6. The overhang portions 5 projecting from the opposite ends 13, 14 of the impact pad are of substantially uniform height above the base, ie the under-surface of the overhang is substantially horizontal and parallel to the plane of the base 2. The thickness of the overhang (i.e. the vertical cross-section) at the centre 11 is preferably less than that at the end portions 9 and 10. FIG. 2A shows a cross-section of the impact pad taken through the line $A^1$—$A^1$ in FIG. 1. It can be seen that the height as measured at equal intervals x along the base of the wall 6 increases smoothly but non-linearly as indicated by the changes in heights in the sequence m1, m2, m3, to a maximum at m4, and then decreases to m5, etc. In this embodiment the width of each arched overhang is constant along its length, but it could increase away in both directions from a central minimum width portion thereof.

Figure 4:
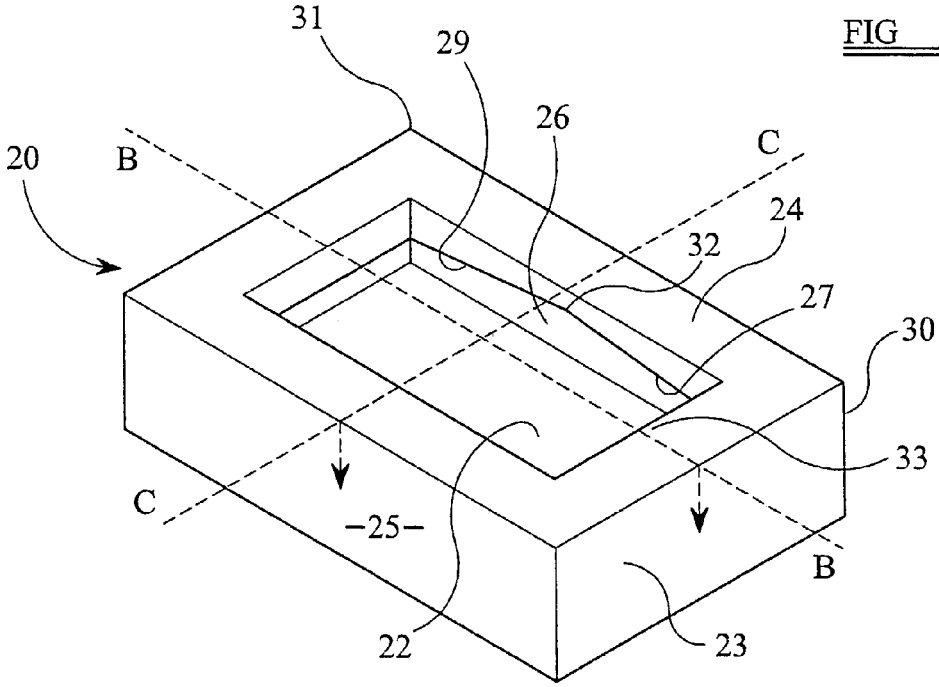
Figure 5:
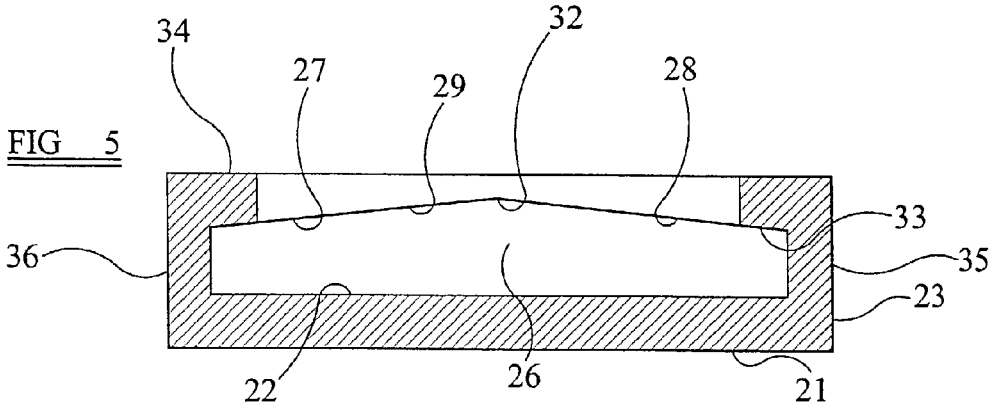
Figure 6:
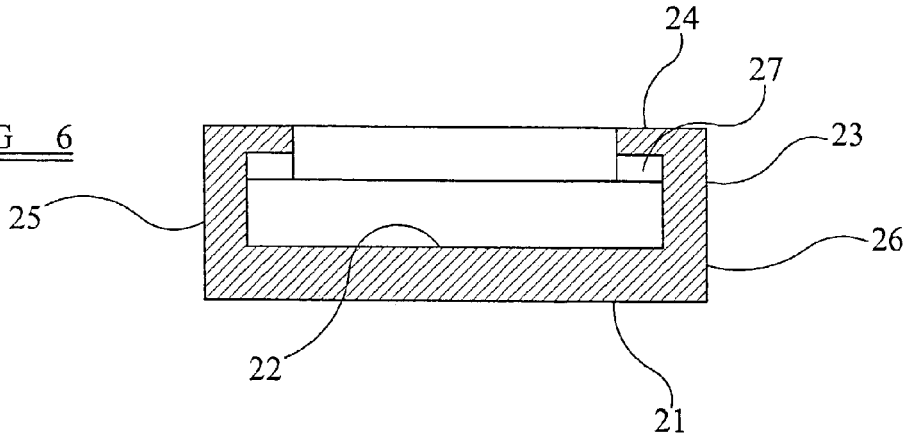
Figure 7:
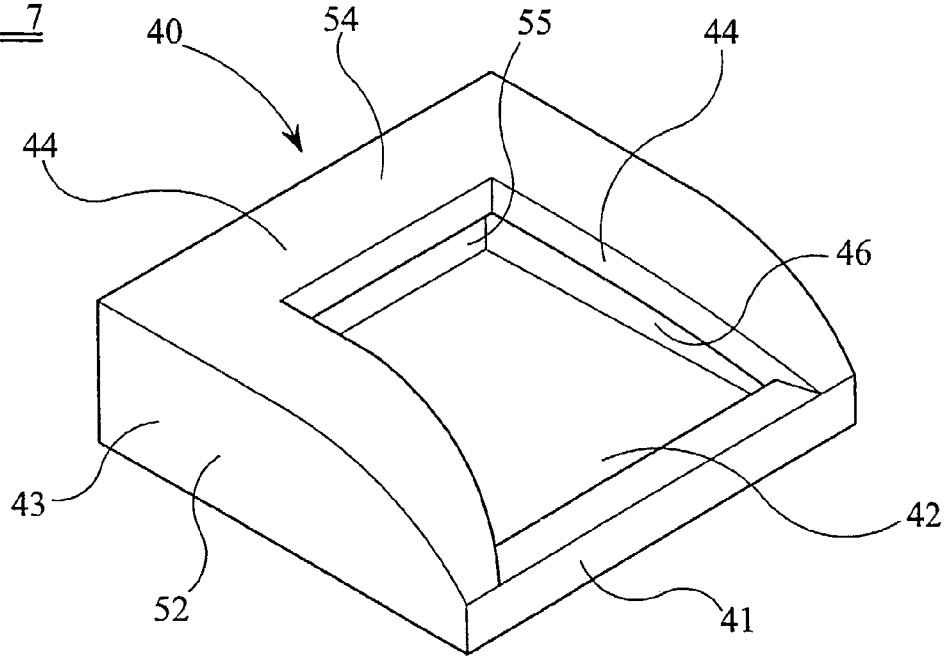

FIGS. 4 to 6 show an impact pad 20 comprising a base 21 having an impact surface 22, a wall 23 extending upwardly from base 21 and an overhang 24 projecting inwardly from wall 23. Along side 26 of the impact pad, the under-surface 27 of the overhang 24 is in the form of a two planar sloping surfaces 28, 29, the lower end of each surface being located near respective corners 30, 31 of the impact pad and meeting at the centre of side 26. Side 25 has an overhang which "mirror images" side 26. Referring to side 26 of the impact pad 20, it can be seen that the vertical height of the overhang above the base increases smoothly and linearly from being a minimum at the corner 31 to being a maximum at the central ridge 32, and then decreases back to a minimum at corner 30. Thus the overhangs on sides 25, 26 each form an arch-shaped roof over the periphery of the base. The overhang portions 33, 34 projecting from the opposite ends 35, 36 of the impact pad are of substantially uniform height above the base, i.e. the under-surface of the overhang is substantially horizontal and parallel to the plane of the base 22. The thickness of the overhang (i.e. the vertical cross-section) at the centre 32 is less than that at the end portions near the corners 30, 31. The top surfaces of the impact pad formed by the upper surfaces of the overhang 24 is planar in this embodiment. Although the width of the sloping overhangs is shown constant, this could vary from a central minimum as described for the embodiment of FIGS. 1 to 3.

FIGS. 7 to 10 show an impact pad 40 comprising a trapezoidal base 41 having an impact surface 42, a wall 43 extending upwardly from base 41 and an overhang 44 projecting inwardly from wall 43. Along side 46 of the impact pad, the under-surface 47 of the overhang 44 is in the form of a surface having a horizontal under-surface 48 and a curved under-surface 49. The lower end 50 of the curved under-surface 49 is at its minimum height, and the latter increases smoothly (but non-linearly) as the under-surface of the overhang 44 curves towards its maximum height at a point 53 near the centre of wall 46. At this point the curved surface levels out to the horizontal and remains at the same height through to the corner 51. Side 52 has an overhang which "mirror images" side 46. The overhang portion 54 projecting over the base 42 is of substantially uniform height above the base, i.e. the under-surface of the overhang portion 54 is substantially horizontal and parallel to the plane of the base 42. A vertical wall 55 at the wider end of the base has no overhang but has a chamfered upper edge 56. The top surface of the impact pad formed by the upper surface of the overhang 44 is planar in the area of overhang 54, and curves smoothly downwardly from the central region toward the end 55. It will be noted from FIG. 8 that the width of each of the curved overhangs 44 decreases from its narrower but higher end at wall 43 to its opposite wider but lower end at wall 55, i.e. from the narrower to the wider end of the trapezoidal base.

Figure 11:
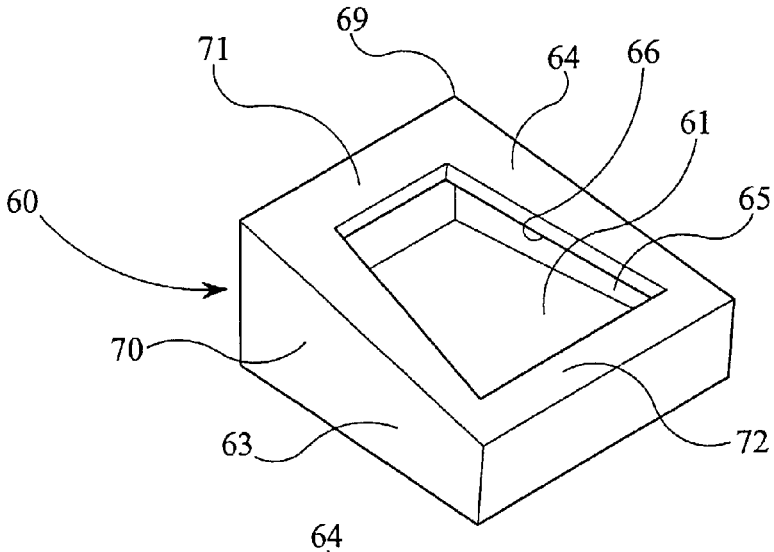

FIGS. 11 to 13 show an impact pad 60, intended for use as "a single strand" impact pad, comprising a trapezoidal base 61 having an impact surface 62, a wall 63 extending upwardly from base 61 and an overhang 64 projecting inwardly from wall 63. Along side 65 of the impact pad, the under-surface 66 of the overhang 64 is a sloping planar surface. The lower end 67 of the sloping under-surface 66 is at its minimum height, and the latter increases smoothly (and linearly) as the under-surface of the overhang 64 slopes upwardly towards its maximum height at a point 68 near the corner 69 of the impact pad. Side 70 has an overhang which "mirror images" side 65. The overhang portion 71 projecting over the base 62 from side 73 of the impact pad is of substantially uniform height above the base, but the plane of the said surface is laterally tilted at a slight acute angle to the surface of the wall 73 from which it extends. The overhang portion 72 projecting over the base 62 from wall 74 of the impact pad is also of substantially uniform height above the base but the plane of the said surface is laterally tilted at a slight obtuse angle to the surface of the wall 74 from which it extends. The top surface of the impact pad formed by the upper surface of the overhang 64 is planar, but is inclined at an angle to the horizontal as can be clearly seen in FIGS. 11 and 12.

As can be seen from FIGS. 11 and 13, the width of each of the sloping overhangs decreases continuously from the narrower to the wider end of the trapezoidal base.

The embodiment shown in FIGS. 14 to 16 is of similar form to the impact pad shown in FIGS. 1 to 3 in that it has a rectangular base 80 and a pair of opposite arched overhangs 81, 82 respectively. However the embodiment shown in FIGS. 14 to 16 differs slightly from that shown in FIGS. 1 to 3 in two respects. Firstly the overhang portions projecting from the opposite ends of the impact pad are not, as with the embodiment of FIGS. 1 to 3, horizontal and parallel to the plane of the base, but, as shown in FIG. 16, are slightly tilted/curved upwardly. Secondly it will be noted that in plan the inner side surface of each of the arched overhangs 81, 82 is itself slightly curved, so that the width of each of these overhangs is at a minimum at the centre/top of the arch, becoming wider in a direction moving away from said centre/top until it reaches maximum width at the ends of the arch. Thus the opening in the top of the impact pad has its longer sides in the form of a shallow concave curve in contrast to the opening shown with the embodiment of FIG. 3 which has straight sides with only slightly curved corners. Finally it will be noted that with the embodiment of FIGS. 14 to 16 the shorter sides of the impact pad are provided with carrying hooks 83.

Figure 17:
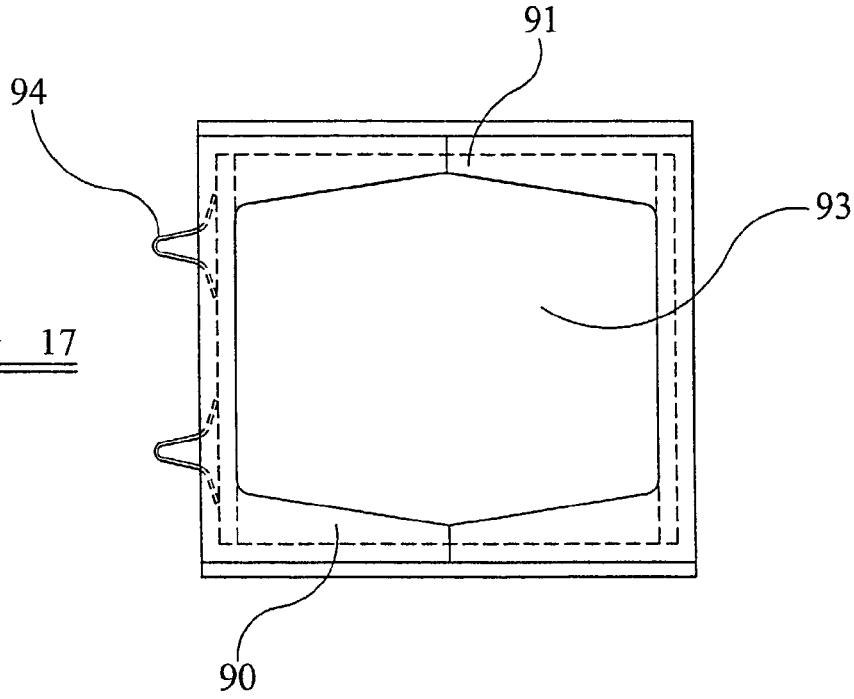
FIG. 17 is a plan view of a further impact pad in accordance with the present invention, of similar form to that shown in FIG. 14, but being more square in plan and again having each overhang increasing in width from its centre to its respective ends.
Figure 18:
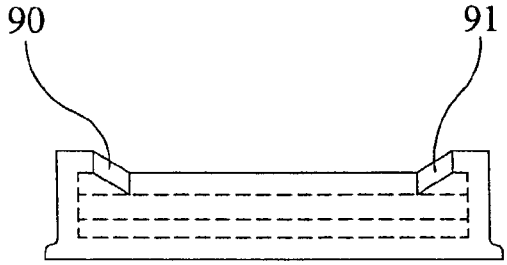
FIG. 18 is an end view of the impact pad of FIG. 17, whilst
Figure 19:
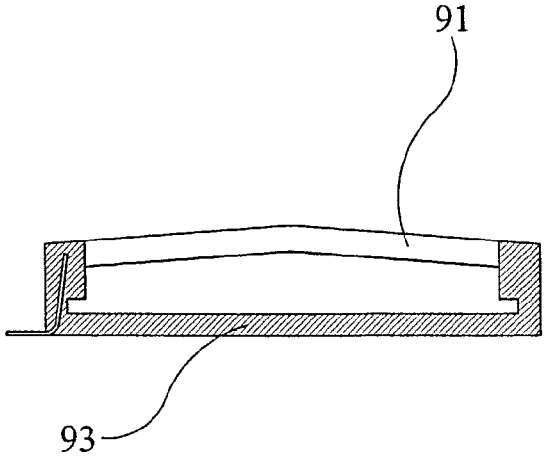
FIG. 19 is a central vertical cross-section through the impact pad of FIG. 17.

The embodiment shown in FIGS. 17 to 19 is similar to that shown in FIGS. 4 to 6 although its base is much squarer. However again a pair of opposite sides of the pad are provided with identical overhangs 90, 91 with the under surface of each overhang in the form of two planar sloping surfaces equivalent to the surfaces 27 and 28 of the embodiment of FIGS. 4 to 6. It will also be noted that with each of these overhangs 90, 91, the overhang has its minimum width at the centre/top of the arch, becoming wider in a direction moving away from said centre/top until it reaches maximum width at the ends of the arch as shown in FIG. 17. As can be seen from FIG. 19, the other pair of sides of the pad have a very short overhang, each with an under surface which is horizontal and parallel to the plane of the base 93. Finally it will be noted that along one of the sides without the sloping overhangs there are provided a pair of hooks 94 of similar form to the hooks 83 of the embodiment shown in FIGS. 14 to 16.

The embodiment shown in FIGS. 20 to 22 is similar to the embodiment shown in FIGS. 17 to 19, in having a pair of overhangs 100, 101 which each have an under-surface in the from of two planar sloping surfaces meeting at the centre of the length of the overhang as shown in FIG. 22. The opposite pair of overhangs each have their respective under-surface angled inwardly and upwardly as shown in FIG. 22. The main difference as compared to the embodiment of FIGS. 17 to 19 relates to the configuration of each of the inner side surfaces of the overhangs 100, 101. As can be seen from FIG. 20, each overhang 100, 101 does have its minimum width at the centre/top of the arch, becoming wider in a direction moving away from said centre/top until it reaches maximum width at the ends of the arch. However instead of this change being continuous as shown for the embodiments of FIGS. 14 and 17 respectively, here the change is discontinuous in that the minimum width portion extends someway at opposite sides of the highest portion of the arch, this minimum width portion then being connected to its maximum width portions at the respective ends of the arch by respective inwardly angled straight portions, so that from one end of the arch to its centre are defined three distinct different width portions of the overhang. As with the other embodiments, the impact pad has a flat base 102.

The embodiment of the invention shown in FIGS. 23 and 24 substantially corresponds to that shown in FIGS. 11 to 13, namely that it is in the form of a "single strand" impact pad having a base 110 of trapezoidal shape. As with the embodiment of FIGS. 11 to 13, the under surface of a pair of overhangs 111, 112 is a sloping planar surface as shown in FIG. 24. Accordingly as with the embodiment of FIGS. 11 to 13, the width of each of these overhangs decreases from a maximum at its end adjacent the narrower end of the pad to a minimum adjacent the wider end of the pad. An outwardly extending hook 112 is provided in the upstanding wall at the narrower end of the pad. As with the embodiment of FIGS. 11 to 13, this wall is vertical whilst the opposite facing wall of the pad slopes outwardly and upwardly and is lower in height than the vertical wall carrying the hook 112.

The embodiment of the invention shown in FIGS. 25 to 27 is similar to that shown in FIGS. 7 to 10 in comprising a base 120 of trapezoidal form. As with the embodiment of FIGS. 7 to 10, each of a pair of opposed overhangs 121, 122 has an under-surface in the form of a surface having a horizontal under-surface and a curved under-surface as shown in FIG. 27. However unlike the embodiments shown in FIGS. 7 to 10, there is no upstanding wall at the wider end of the base 120, so that, in effect, the base 120 merely runs out at the open end of the impact pad. In other words the vertical wall 55 of the embodiment shown in FIGS. 7 to 10 is omitted. Lastly it will be noted that a hook 123 is embedded in the base 120 and extends therefrom through the bottom of the wall upstanding from the base at its narrower end.

Finally it will be noted that FIG. 28 shows an embodiment equivalent to that shown in FIG. 25, but with a square rather than a trapezoidal base.

In a further embodiment shown in FIGS. 29 to 31 one or both of the sloping overhangs 130, 131, which are equivalent to overhangs 111, 112 of the FIGS. 23 and 24 arrangement, could terminate short of the wider end of the pad, as shown for overhang 130. The wider end wall 132 of the pad has no overhang and its outer surface is angled upwardly and inwardly.

It has been found that whilst the curving or sloping of the under-surfaces of the overhangs produces an improved performance, in use, improved performance is also produced without such curving or sloping if the width of at least one overhang is varied along its length, in other words if the shape of the inlet opening in the top surface of the impact pad is not uniform. Although an improved effect can be provided by varying the width of only one of the overhangs, preferably the variation would be with each overhang in an opposite pair of overhangs, for example those shown sloping or curved in the embodiments described. However the variation in width could be applied to all the overhangs of the pad whether it is 3 or 4 sided. Moreover as described with the embodiments above, the various changes in width could be continuous or discontinuous and where continuous, could be by way of curved surfaces as shown in FIG. 14 or straight angled surfaces as shown in FIG. 17. Any form of discontinuous variation of the width, for example as shown in FIG. 20 would also be suitable. With specific forms of impact pad, for example of trapezoidal shape for single-strand use, the variation can be continuous as shown in FIGS. 23 and 25 rather than the variation being at respective opposite sides of a central portion as shown in FIGS. 14, 17 and 20.

However performance is particularly improved over known impact pad devices if the pad incorporates a combination of the curving or sloping of the under-surfaces of at least one overhang with the width of such overhang or other overhang varying as described in the embodiments herein. This reduces the velocity of the stream of molten metal entering the tundish as compared to a concentric design thereof. In particular a pad of the present invention produces a more controlled flow through the tundish and less dead time for metal therein.

What is claimed is:

1. A tundish impact pad formed from refractory material comprising a base having an impact surface which, in use, faces upwardly against a stream of molten metal entering a tundish, a wall extending upwardly from the base around at least a part of the periphery of the impact surface, one or more portions of the upper part of the wall supporting one or more overhangs which project inwardly over the periphery of the base, wherein the overhang or at least one of said overhangs has at least a part whose under-surface curves or slopes, the curvature or slope lying in a direction along the length of the wall.

2. A tundish impact pad as claimed in claim 1, wherein the overhang having the defined curved and/or sloping under-surface is present along at least 40% of the perimeter of the impact pad.

3. A tundish impact pad as claimed in claim 1, wherein the base is square, rectangular or trapezoidal.

4. A tundish impact pad as claimed in claim 1, wherein the angle formed between the horizontal, and a straight line joining the lowest and highest points of said curved or sloping part lies in the range 50° to 200°.

5. A tundish impact pad as claimed in claim 1, wherein at least one of said overhangs has at least a part whose under-surface curves such that, in a vertical cross-section taken through the overhang in a plane parallel to the plane of the wall, the angles made between tangents to the curve and the horizontal lie in the range of 0° to 45°.

6. A tundish impact pad as claimed in claim 5, wherein the undersurface is in the form of an arch or partial arch.

7. A tundish impact pad as claimed in claim 1, wherein the wall extends around the entire periphery of the base.

8. A tundish impact pad as claimed in claim 7, having a square, rectangular or trapezoidal base, and being provided with one pair of overhangs having curved or sloping under-surfaces on a pair of oppositely disposed walls, and a second pair of overhangs having horizontal planar under-surfaces on the second pair of walls.

9. A tundish impact pad as claimed in claim 8, wherein the pair of overhangs having curved or sloping under-surfaces each have the shape of an arch.

10. A tundish impact pad as claimed in claim 9, wherein at least one arch has its minimum width at the centre/top of the arch, becoming wider in a direction moving away from said centre/top until it reaches maximum width at the ends of the arch.

11. A tundish impact pad as claimed in claim 10, wherein the width of said at least one arch decreases continuously from its centre/top to each of its ends.

12. A tundish impact pad as claimed in claim 10, wherein the width of said at least one arch decreases discontinuously from its centre/top to each of its ends.

13. A tundish impact pad as claimed in claim 9, wherein at least one arch has its minimum width at the centre/top of the arch, becoming wider in a direction moving away from said centre/top, reaching its maximum thickness before each of its ends.

14. A tundish impact pad as claimed in claim 1, having a square, rectangular or trapezoidal base, a peripheral wall surrounding three sides of the base, the pair of oppositely disposed walls being provided with one pair of overhangs having curved or sloping under-surfaces, the third wall having an overhang having a horizontal planar under-surface.

15. A tundish impact pad as claimed in claim 14, wherein the peripheral wall surrounds only three sides of the base.

16. A tundish impact pad as claimed in claim 14, wherein the peripheral wall surrounds all four sides of the base, with the fourth wall having no overhang.

17. A tundish impact pad as claimed in claim 14, wherein the peripheral wall surrounds all four sides of the base, and the oppositely disposed third and fourth walls are of different heights respectively.

18. A tundish impact pad as claimed in claim 14, wherein the pair of overhangs having curved or sloping under-surfaces each have the shape of an arch.

19. A tundish impact pad as claimed in claim 18, wherein at least one arch has its minimum width at one end thereof and its maximum width at the opposite end thereof.

20. A tundish impact pad as claimed in claim 19, wherein the width of said at least one arch decreases continuously from its minimum to its maximum width.

21. A tundish impact pad as claimed in claim 19, wherein an inner side face of said at least one arch is straight or curved to define said continuous decrease of width.

22. A tundish impact pad formed from refractory material comprising a base having an impact surface which, in use, faces upwardly against a stream of molten metal entering a tundish, a wall extending upwardly from the base around at least a part of the periphery of the impact surface, one or more portions of the upper part of the wall supporting one or more overhangs which project inwardly over the periphery of the base, wherein the overhang or at least one of the overhangs has a minimum width at its centre between two oppositely directed walls and becomes wider in a continuous manner in a direction moving away from said centre, reaching maximum width at its ends.

23. A tundish impact pad as claimed in claim 22, wherein an inner side face of the or each of said overhangs is straight or curved to define said continuous decrease of width.

24. A tundish impact pad formed from refractory material comprising a base having an impact surface which, in use, faces upwardly against a stream of molten metal entering a tundish, a wall extending upwardly from the base around at least a part of the periphery of the impact surface, one or more portions of the upper part of the wall supporting one or more overhangs which project inwardly over the periphery of the base, wherein the or each overhang has a minimum width at one end thereof and a maximum width at the opposite end thereof.

25. A tundish impact pad as claimed in claim 24, wherein an inner side face of the or each of said overhangs is straight or curved to define said continuous decrease of width.

* * * * *